United States Patent [19]

Hemmer et al.

[11] 4,019,852

[45] Apr. 26, 1977

[54] QUIET AND SMOKELESS FLARING OF OFF-GASES CONTAINING HYDROCARBONS

[75] Inventors: Gerd Hemmer, Ludwigshafen; Klaus Hess, Bad Durkheim; Rolf Becker, Luetzelsachsen; Klaus Liebhaber, Frankenthal, all of Germany

[73] Assignee: BASF Aktiengesellschaft, Ludwigshafen (Rhine), Germany

[22] Filed: Oct. 20, 1975

[21] Appl. No.: 623,932

[30] Foreign Application Priority Data

Oct. 23, 1974 Germany ..... 2450205

[52] U.S. Cl. ..... 431/5; 239/DIG. 7; 431/202

[51] Int. Cl.[2] ..... F23G 7/06

[58] Field of Search ..... 431/5, 4, 3, 202, 190; 239/DIG. 7, 428.5; 23/277 O

[56] References Cited

UNITED STATES PATENTS

| | | | |
|---|---|---|---|
| 3,817,695 | 6/1972 | Reed et al. | 431/202 |
| 3,833,337 | 9/1974 | Desty et al. | 431/202 X |
| 3,840,320 | 10/1974 | Desty et al. | 431/5 X |
| 3,853,457 | 10/1974 | Desty et al. | 431/202 X |
| 3,914,093 | 10/1975 | Proctor | 431/202 X |

*Primary Examiner*—Edward G. Favors
*Attorney, Agent, or Firm*—Johnston, Keil, Thompson & Shurtleff

[57] ABSTRACT

A process for the quiet and smokeless flaring of process gases by sharp separation of the air intake and combustion steps. Compared with conventional off-gas flares, steam consumption is reduced and blow-back of the flame into the mixing tube is avoided by using a combined mixing and combustion chamber. This extends the operating range and life of flare facilities.

8 Claims, 4 Drawing Figures

FIG. 1
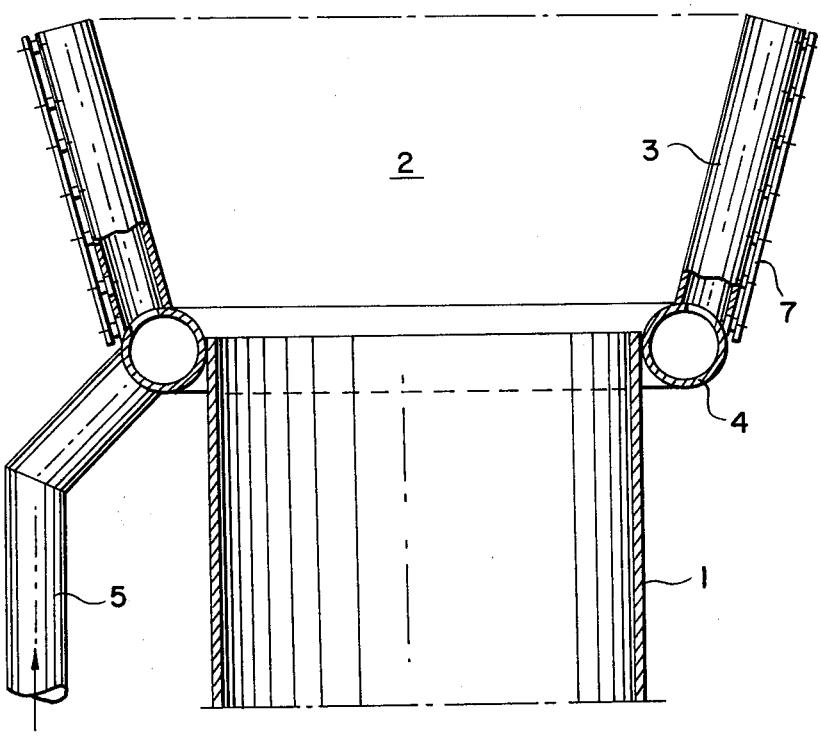
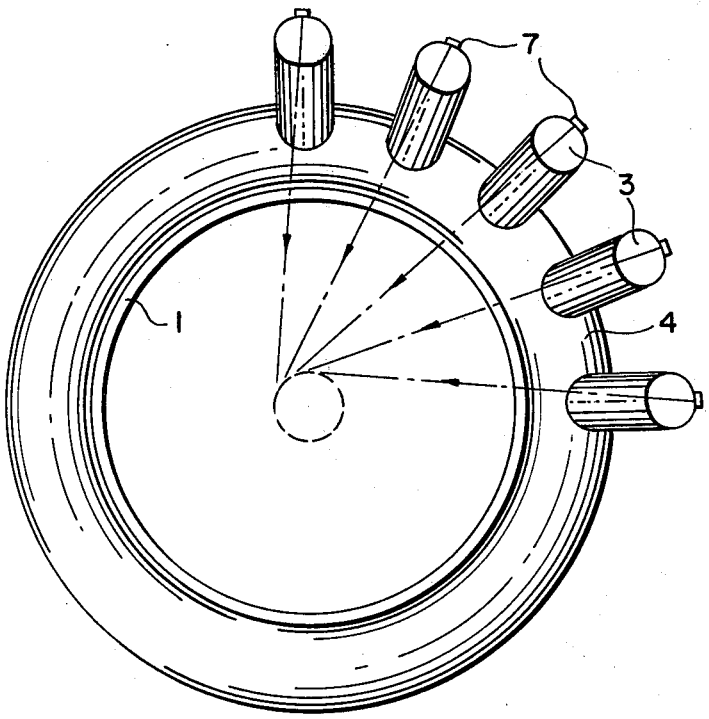
FIG. 2

QUIET AND SMOKELESS FLARING OF OFF-GASES CONTAINING HYDROCARBONS

The present invention relates to a process for the quiet and smokeless flaring of process gases, preferably off-gases containing hydrocarbons, by admixture of air before combustion.

In refineries and petrochemical installations, off-gases are formed during start-up and shut-down of units, especially in the case of an emergency shut-down, and because of their particular composition these off-gases cannot be processed further. Instead, they are in most cases burnt in flare facilities.

However, almost all off-gases containing hydrocarbons form smoke when burnt in the atmosphere. The cause of this is the cracking and polymerization reactions which take place in the core of the flame due to high temperatures and an insufficient supply of oxygen. Smoke formation can be suppressed by admixture of atmospheric oxygen before the reaction, since the rate of the oxidation reaction is substantially greater than that of the intermediate reactions in which smoke is formed.

It is known that the atmospheric oxygen required can either be inspirated by the off-gas itself before combustion or fed into the off-gas by injectors, steam being usually used as the propellant.

The first-mentioned type of flare, in which the off-gases themselves inspirate the combustion air prior to combustion, can only be employed if the gases have a sufficiently high pressure. Downstream of the gas feed pipe, from which the gas issues with sufficiently high momentum, there can be arranged a Venturi mixing tube in which the gas and the inspirated air are mixed, the tube outlet functioning as a burner with a flame-holding grid, cf. Chem. Tech., 18. 266–272, 1966.

A similar construction which uses an annular nozzle in place of the central gas orifice is disclosed in German Pat. No. 2,143,520. It has a cylindrical mixing tube, with a blow-back prevention device at its outlet.

In another type of construction, the mixing tube is dispensed with, since the flame can blow back into it if the throughput is too low. The gas issues horizontally through an annulus, the area of which is pressure-controlled, and flows, as a wall jet, over a convex body until the direction of flow has been changed to vertical. During its travel, the wall jet draws in combustion air. In half of the body, the flame becomes stabilized, cf. Petroleum and Petrochemical International, 13, 86 – 90, 1973.

To avoid long flares, a plurality of self-aspirating small flares can be provided in one plane. A hexagonal combustion surface with 270 individual burners operating an annular gap ejectors is disclosed in German Pat. No. 2,327,017.

The other type of flare, in which combustion air is injected into the off-gas by means of a propellant, has to be employed for off-gases which are at only slightly superatmospheric pressure and therefore possess little momentum as they issue from the jet. The combustion air can in that case be introduced either by increasing the momentum by steam nozzles in the gas stream or by using injectors, with steam or compressed air as the propellant, at the flare tip.

A combined arrangement in which injectors without mixing tubes are arranged in a ring, pointing upwards at an angle, round the tip and a steam injector with air feed pipe is additionally located at the central axis of the flare stack is described in German Pat. No. 1,144,869.

A similar arrangement with injectors without mixing tubes arranged as a ring around the flare tip, but with a multijet arrangement with a mixing tube in the gas stream, is disclosed in Chem. Tech., 18, 266 – 272, 1966.

A Bunsen flare with steam as the propellant is disclosed in German Pat. No. 1,751,134. Here, not only is air drawn in by the steam in a mixing tube, but the flare gas is admixed at the same time. As a result of the homogeneous mixing achieved, this type of flare is less prone to smoking. However, the flame can blow back into the mixing tube.

A conically outward-tapered flare tip is described in Chemical Engineering Progress, 69, 60 – 64, October 1973, in which a ring of steam jets is located round the base of the flame. The injectors used are annular injectors which are quiet because the narrow annulus has a relatively high periphery to area ratio.

With the two types of flare mentioned, off-gases of various compositions can be burnt without smoke being formed. In the flare type using steam injection, from 0.5 to 1.5 kg of steam per kg of off-gas is required, depending on the injector construction and the gas composition, to suppress smoke.

The differing amounts of steam required to achieve smokeless flaring show that an optimum design of the injectors and of their arrangement to provide air has not yet been achieved. Art flaring therefore entails substantial running costs. Furthermore, the high steam consumption leads to two sources of noise:

1. The let-down of the steam from super-critical pressure at the injectors.

2. Unstable conditions in the flame zone, resulting from the steam and air feed and the increasing flow velocity.

It is an object of the invention to improve the air intake as a result of a sharp separation between air intake and combustion and as a result of the injector construction, and thereby to reduce the high steam consumption of known flares, to minimize noise as a result of stable combustion and low outlet cross-sections of the injectors, and to reduce luminosity as a result of good mixing.

It is a further object of the invention to extend the range of operation and life (i.e. heat load) of flare facilities by means of a combined mixing and combustion chamber which is formed by injector tubes and which, in contrast to conventional premixed flaring, prevents blow-back of the flame into the mixing tube.

According to the invention, this object is achieved by arranging around a flare tip a circle of injector tubes which introduce over their entire length air by means of a propellant into the off-gas stream at right angles to its flow and which at the same time produce a sharp separation between the air intake by the propellant and the mixing of the air/propellant mixture with the off-gas.

The propellant used for air intake may be steam, air or other gaseous media.

In the process according to the invention, it is desirable for the concentrically arranged injector tubes to be inclined outwards at an angle of from 10° to 20° relative to the flare stack axis and for the stream vectors from the injector tubes to form, in the same direction of rotation, a circle of tangents around the axis of the flare stack or to meet at this axis.

A further object of the invention is to provide a device in which the concentrically arranged injector tubes draw in air on their outward-facing side which is mixed with the off-gas in the mixing chamber formed by the injector tubes.

The mixing chamber formed by the injector tubes and the flare are advantageously surrounded by a concentric pipe so that the amount of inspirated air may be regulated by means of flaps.

According to the invention, the propellant in the injector tubes flows through slits and is deflected at right angles and divided into two streams by a flat piece of iron (a bar) which together with spacers and the injector tube forms outlet slits. The two part-streams hug the injector tube walls (forming a wall jet) and as a result are again deflected at right angles.

The advantages achieved by the invention are:

1. Stable and therefore low-noise combustion, since the outlet cross-section of the mixing chamber can be adapted to the stability conditions.

2. Combustion which is smokeless and even non-luminous, since, as a result of the sharp separation of the injector tubes between air intake and admixture with the off-gas, the air intake is not affected by the combustion gases even in strong wind.

3. Little noise from the let-down of the propellant from supercritical pressure, since the periphery to area ratio is high.

An embodiment of the invention is explained in more detail below in relation to the drawings.

FIG. 1 shows a longitudinal section through the flare tip.

FIG. 2 shows a plan view of the flare tip with a 90° segment containing the injector tubes.

Figure 3:
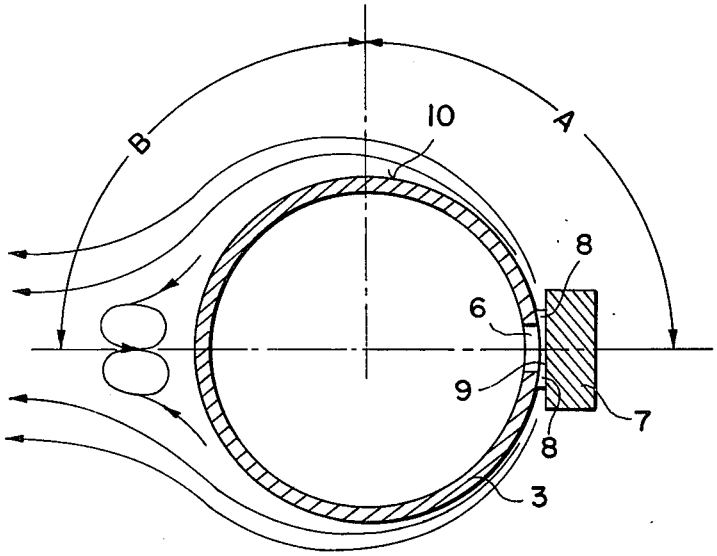
FIG. 3 shows the construction and mode of operation of an injector tube.
Figure 4:
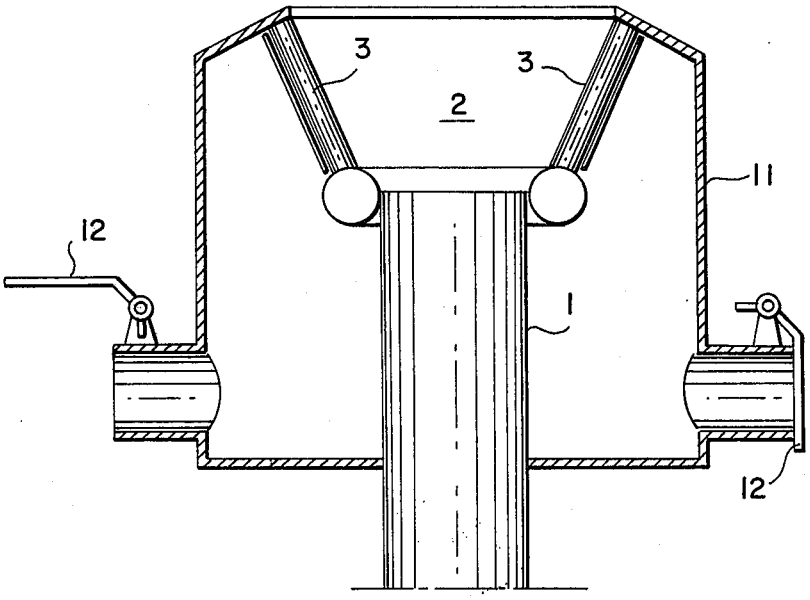
FIG. 4 shows an additional device for regulating the air supply.

The burner according to the invention consists of a flare stack 1 which opens into a combined mixing and combustion chamber 2. The mixing and combustion chamber 2 is formed by injector tubes 3 which form a circle, tapering conically outwards, round the tip of the flare stack 1. The injector tubes 3 are mounted on an annular tube 4 which is supplied with steam from line 5.

The process according to the invention operates as follows: the steam or other propellant flows through slits 6 on the injector tubes 3 and is deflected at right angles and divided into two partstreams by a flat piece of iron 7, which together with the injector tube 3 and the spacers 9 forms the outlet slits 8 (FIG. 3). The two part-streams exit through the outlet slits 8. The steam streams which form hug the walls 10 of the injector tubes (forming a wall jet) and are as a result again deflected at right angles. At the same time, the streams inspirate combustion air on their way through the first quadrant. In the second quadrant, which faces the mixing and combustion chamber 2, the momentum of the steam/air stream is used to mix the combustible gas in the flare stack 1 with the steam and the air. The stream from the individual injector tubes can be directed past the axis of the mixing and combustion chamber 2, so that a vortex is produced, as a result of which the off-gases, when they issue from the flare tip, mix better with the atmospheric air. Alternatively, the stream vectors of the injector tubes can meet at the axis of the stack so that as a result of the aerodynamic situation at the axis of the stack, the off-gas is forced to its periphery; as a consequence the flare is steadier.

The mixing chamber 2 formed by the injector tubes 3, and the flare stack 1, are surrounded by a concentric pipe 11; the amount of air inspirated can be regulated by means of flaps 12.

Depending on the throughput, combustion starts either in the backflow zone downstream of the injector tubes within the mixing chamber defined by them, since there the axial velocities are low, or only at the mixing chamber outlet. Ignition in these stabilization zones is effected by any conventional means.

The dimensions and operating data relating to the process of the invention are shown for two examples in Table 1.

TABLE 1

| Example | | 1 | 2 |
|---|---|---|---|
| Amount of gas | | 1,000 m³/hr | 15,000 m³/hr |
| Type of gas | | propylene, butane | crack gas |
| Diameter of flare stack | (1) | 150 mm | 700 mm |
| Diameter of the annular tube | (4) | 108 × 4 mm | 168 × 4.5 mm |
| Diameter of center circle of annular tube | (4) | 277 mm | 880 mm |
| Pitch circle for injector tubes, bottom | | 323 mm | 880 mm |
| Pitch circle for injector tubes, top | | 460 mm | 1,150 mm |
| Diameter of injector tubes | (3) | 52 × 7 mm | 108 × 4 mm |
| Length of injector tubes | (3) | 270 mm | 520 mm |
| Number of slits per injector tube | (6) | 3 | 6 |
| Width of slits | (6) | 6 mm | 6 mm |
| Length of slits | (6) | 60 mm | 60 mm |
| Width of outlet slits | (8) | 0.26 | 0.35–0.40 |
| Outlet cross-section | | 1,030 mm² | 3,224 mm² |
| Pitch of injector tubes, bottom | | 92.5 mm | 173 mm |
| Pitch of injector tubes, top | | 131.5 mm | 225 mm |
| Distance between adjacent tubes at bottom | | 40.5 mm | 66 mm |
| Distance between adjacent tubes at top | | 79.5 mm | 119 mm |
| Pressure range | | 0.2–3 bars | 0.2–3.5 bars |
| Operating pressure at rated throughput | | 1.5 bars | 3.0 bars |
| Steam consumption at rated throughput | | 1–1.3 tonnes/hr | 8 tonnes/hr |
| Air intake | | 8–10 kg/kg of steam | 8–10 kg/kg of steam |
| Noise level at rated throughput, at 10 meters distance | | | |
| 1. without flare | | 81 dBA | 97 dBA |
| 2. with flare | | 86 dBA | — |

We claim:

1. A process for the quiet and smokeless flaring of combustible process gases from a flare stack which comprises discharging from the end of a flare stack a stream of a combustible process gas into a mixing zone located within a series of injector tubes arranged in a circle about and extending beyond said end of the flare stack, and discharging through respective longitudinal passages in the outwardly facing sides of said tubes and then about said tubes toward said mixing zone a stream of propellant gas for drawing atmospheric air between said tubes and through said circle into said stream of combustible gas.

2. A process as claimed in claim 1 wherein said propellant gas is steam or air, and providing a sharp separation between the atmospheric air intake by the propellant gas and the mixing of the air/propellant gas mixture with said stream of combustible gas within said mixing zone.

3. A process as claimed in claim 1, and deflecting the streams of propellant gas discharged from said longitudinal passages laterally of both longitudinal sides of said passages, thereby providing a wall jet of propellant gas flowing about the walls of said tubes toward said mixing zone and thereby inducing atmospheric air intake by said wall jets through the spaces between said tubes.

4. A process as claimed in claim 3 wherein said injector tubes are inclined outwardly at an angle of from 10° to 20° relative to the flare stack axis.

5. A process as claimed in claim 1 wherein said injector tubes are inclined outwardly at an angle of from 10° to 20° relative to the flare stack axis.

6. Apparatus for the quiet and smokeless flaring of combustible process gases from a flare stack which comprises a flare stack, a plurality of injector tubes positioned concentrically about the axis of the flare stack and projecting beyond the tip of said stack, and said tubes having respective, gas-discharge slot means extending along the length of the outwardly facing side of each tube for discharging respective streams of propellant gas along the stack-remote sides of said tubes.

7. Apparatus as claimed in claim 6, and a bar mounted on the outwardly facing side of each tube opposite the discharge slot means and in spaced relationship to the tube for deflecting the propellant gas stream laterally of the slot means.

8. Apparatus as claimed in claim 6, and wall means forming a mixing chamber surrounding the tip portion of the stack and the injector tube assembly, passage means for admitting atmospheric air into said chamber, and flap means on said passage means for regulating the amount of air drawn into said chamber.

* * * * *